US009515396B2

(12) United States Patent
Chikusa

(10) Patent No.: US 9,515,396 B2
(45) Date of Patent: Dec. 6, 2016

(54) FEMALE TERMINAL FITTING

(71) Applicant: Sumitomo Wiring Systems, Ltd., Yokkaichi, Mie (JP)

(72) Inventor: Takahiro Chikusa, Mie (JP)

(73) Assignee: Sumitomo Wiring Systems, Ltd., Yokkaichi Mie (JP)

( * ) Notice: Subject to any disclaimer, the term of this patent is extended or adjusted under 35 U.S.C. 154(b) by 0 days.

(21) Appl. No.: 14/771,884

(22) PCT Filed: Mar. 5, 2014

(86) PCT No.: PCT/JP2014/055544

§ 371 (c)(1),
(2) Date: Sep. 1, 2015

(87) PCT Pub. No.: WO2014/136809

PCT Pub. Date: Sep. 12, 2014

(65) Prior Publication Data

US 2016/0013569 A1 Jan. 14, 2016

(30) Foreign Application Priority Data

Mar. 5, 2013 (JP) ..... 2013-043125

(51) Int. Cl.
*H01R 4/48* (2006.01)
*H01R 13/11* (2006.01)
*H01R 13/115* (2006.01)

(52) U.S. Cl.
CPC ..... *H01R 4/48* (2013.01); *H01R 13/113* (2013.01); *H01R 13/115* (2013.01)

(58) Field of Classification Search
CPC .... H01R 13/113; H01R 13/11; H01R 13/187
USPC ..... 439/852
See application file for complete search history.

(56) References Cited

U.S. PATENT DOCUMENTS 4,838,816 A * 6/1989 Matsusaka ..... H01R 13/193 439/395
5,112,254 A * 5/1992 Endo ..... H01R 43/16 439/852

(Continued)

FOREIGN PATENT DOCUMENTS

JP 7-29759 6/1995
JP 8-31490 2/1996

(Continued)

OTHER PUBLICATIONS

International Search Report.

*Primary Examiner* — Ross Gushi
(74) *Attorney, Agent, or Firm* — Gerald E. Hespos; Michael J. Porco; Matthew T. Hespos

(57) ABSTRACT

A female terminal fitting (10) includes a tubular main body (20) and a resilient contact piece (28) deflectably arranged in the main body portion (20). When being inserted into the main body portion (20), a mating male tab (90) comes into contact with the resilient contact piece (28) to deflect and deform the resilient contact piece (28) toward a base wall (21) of the main body portion (20). Excessive deflection regulating portions (37) arranged at positions facing the resilient contact piece (28) in a deflecting direction of the resilient contact piece (28) and configured to regulate excessive deflection of the resilient contact piece (29) are provided on the base wall (21) of the main body portion (20). The excessive deflection regulating portions (37) are bottom-raised toward the resilient contact piece (28) with respect to reference surfaces of the base wall (21).

6 Claims, 6 Drawing Sheets

(56) References Cited

U.S. PATENT DOCUMENTS 5,350,321 A * 9/1994 Takenouchi ..... H01R 13/115 439/839
5,443,592 A * 8/1995 Ittah ..... H01R 13/113 439/839
5,540,603 A * 7/1996 Fujiwara ..... H01R 13/11 439/839
5,562,501 A * 10/1996 Kinoshita ..... H01R 13/113 439/851
5,601,458 A * 2/1997 Ohsumi ..... H01R 13/187 439/851
5,611,715 A * 3/1997 Samejima ..... H01R 13/113 439/850
5,735,717 A 4/1998 Nabeshima
5,791,945 A * 8/1998 Myer ..... H01R 13/113 439/852
5,839,925 A * 11/1998 Simmons ..... H01R 13/4364 439/595
5,941,741 A * 8/1999 Dobbelaere ..... H01R 13/113 439/852
6,019,646 A * 2/2000 Okamura ..... H01R 13/113 439/748
6,062,918 A * 5/2000 Myer ..... H01R 13/187 439/833
6,152,788 A * 11/2000 Hata ..... H01R 13/113 439/51
6,290,553 B1 * 9/2001 Sato ..... H01R 13/187 439/843
6,293,833 B1 * 9/2001 Kamath ..... H01R 13/113 439/839
6,305,992 B1 * 10/2001 Bouda ..... H01R 13/113 439/834
6,364,722 B1 * 4/2002 Yamamoto ..... H01R 13/113 439/850
6,475,040 B1 * 11/2002 Myer ..... H01R 13/11 439/374
6,478,636 B1 * 11/2002 Makita ..... H01R 13/113 439/852
6,506,084 B2 * 1/2003 Saitoh ..... H01R 13/11 439/843
6,520,811 B2 * 2/2003 Mitani ..... H01R 13/113 439/843
6,524,143 B2 * 2/2003 Chen ..... H01R 13/187 439/852
6,527,601 B2 * 3/2003 Chen ..... H01R 13/187 439/851
6,547,608 B2 * 4/2003 Sato ..... H01R 13/11 439/851
6,645,003 B2 * 11/2003 Yoshida ..... H01R 29/00 439/507
6,736,684 B2 * 5/2004 Ishiyama ..... H01R 13/187 439/852
6,971,927 B2 * 12/2005 Anbo ..... H01R 13/113 439/852
7,144,281 B2 * 12/2006 Maeda ..... H01R 43/16 439/595
7,156,704 B2 * 1/2007 Shimizu ..... H01R 13/113 439/852
7,229,329 B2 * 6/2007 Yamashita ..... H01R 13/11 439/595
7,252,564 B1 * 8/2007 Morello ..... H01R 4/185 439/843
7,347,747 B2 * 3/2008 Shimizu ..... H01R 13/11 439/842
7,374,465 B2 * 5/2008 Tanaka ..... H01R 13/113 439/595
7,387,550 B2 * 6/2008 Myer ..... H01R 13/113 439/852
7,419,411 B2 * 9/2008 Kaneko ..... H01R 13/113 439/851
7,458,864 B2 * 12/2008 Philipp ..... H01R 13/113 439/851
7,513,806 B2 * 4/2009 Noda ..... H01R 13/04 439/852
7,530,859 B2 * 5/2009 Moll ..... H01R 4/185 439/852
7,856,712 B2 * 12/2010 Busies ..... H01R 13/113 29/874
7,938,695 B2 * 5/2011 Furutani ..... H01R 4/185 439/852
7,938,699 B2 * 5/2011 Okano ..... H01R 4/185 439/877
7,985,106 B2 * 7/2011 Sugiyama ..... H01R 13/113 439/852
8,021,200 B2 * 9/2011 Myer ..... H01R 13/113 439/857
8,043,130 B2 * 10/2011 Casses ..... H01R 13/11 439/850
8,118,621 B2 * 2/2012 Fukase ..... H01R 13/113 439/852
8,241,076 B2 * 8/2012 Kubota ..... H01R 13/113 439/852
8,241,077 B2 * 8/2012 Suzuki ..... H01R 13/114 439/839
8,333,622 B2 * 12/2012 Blasko ..... H01R 13/113 439/595
8,371,883 B2 * 2/2013 Kimura ..... H01R 13/113 439/852
8,454,394 B2 * 6/2013 Iihoshi ..... H01R 13/11 439/845
8,523,619 B2 * 9/2013 Itou ..... H01R 13/113 439/852
8,662,935 B2 * 3/2014 Jouas ..... H01R 13/113 439/660
8,747,156 B2 * 6/2014 Hirabayashi ..... H01R 13/113 439/595
8,784,144 B2 * 7/2014 Hirabayashi ..... H01R 13/113 439/852
8,821,197 B2 * 9/2014 Muro ..... H01R 13/113 439/830
8,845,362 B2 * 9/2014 Chikusa ..... H01R 13/4223 439/595
8,858,259 B2 * 10/2014 Chikusa ..... H01R 13/4223 439/595
8,905,798 B2 * 12/2014 Amano ..... H01R 4/48 439/817
8,911,253 B2 * 12/2014 Myer ..... H01R 13/113 439/561
8,944,861 B2 * 2/2015 Amano ..... H01R 13/11 439/852
8,974,256 B2 * 3/2015 Okano ..... H01R 13/11 439/852
8,998,656 B2 * 4/2015 Amano ..... H01R 13/113 439/845
9,011,186 B2 * 4/2015 Wirth ..... H01R 13/112 439/843
9,017,113 B2 * 4/2015 Haga ..... H01R 13/03 439/816
9,099,796 B2 * 8/2015 Myer ..... H01R 13/113
9,105,995 B2 * 8/2015 Tsuji ..... H01R 13/187
9,118,130 B1 * 8/2015 Volpone ..... H01R 13/113
9,160,082 B2 * 10/2015 Heringhaus ..... H01R 13/187
9,184,513 B2 * 11/2015 Tanigawa ..... H01R 13/187
9,236,675 B2 * 1/2016 Tsuji ..... H01R 13/187
2001/0002350 A1 * 5/2001 Kashiyama ..... H01R 13/11 439/848
2001/0051472 A1 * 12/2001 Sato ..... H01R 13/11 439/852
2002/0076999 A1 * 6/2002 Chen ..... H01R 13/187 439/851
2003/0190847 A1 * 10/2003 Nankou ..... H01R 13/113 439/852
2003/0224668 A1 * 12/2003 Matsuda ..... H01R 13/113 439/839
2004/0224573 A1 * 11/2004 Yoshida ..... H01R 13/11 439/852
2005/0227551 A1 * 10/2005 Tabata ..... H01R 13/113 439/852
2007/0099520 A1 * 5/2007 Anbo ..... H01R 4/185 439/852
2007/0218733 A1 * 9/2007 Philipp ..... H01R 13/113 439/188
2008/0070452 A1 * 3/2008 Komiyama ..... H01R 13/113 439/852
2010/0029146 A1 * 2/2010 Myer ..... H01R 13/15

(56) References Cited

U.S. PATENT DOCUMENTS

| | | | | |
|---|---|---|---|---|
| | | | | 439/852 |
| 2010/0130075 | A1* | 5/2010 | Casses | H01R 43/16 439/852 |
| 2010/0197177 | A1* | 8/2010 | Myer | H01R 13/113 439/852 |
| 2012/0142233 | A1* | 6/2012 | Blasko | H01R 13/113 439/852 |
| 2012/0252283 | A1* | 10/2012 | Muro | H01R 13/113 439/839 |
| 2012/0289100 | A1* | 11/2012 | Ishida | H01R 13/113 439/858 |
| 2013/0260598 | A1* | 10/2013 | Chikusa | H01R 13/4223 439/357 |
| 2013/0288546 | A1* | 10/2013 | Okano | H01R 13/113 439/852 |
| 2013/0288547 | A1* | 10/2013 | Amano | H01R 13/11 439/852 |
| 2013/0288548 | A1* | 10/2013 | Amano | H01R 13/187 439/852 |
| 2014/0011410 | A1* | 1/2014 | Hamai | H01R 13/187 439/847 |
| 2014/0141662 | A1* | 5/2014 | Kutsuna | H01R 13/114 439/888 |
| 2014/0287634 | A1* | 9/2014 | Tsuji | H01R 13/187 439/852 |
| 2014/0287635 | A1* | 9/2014 | Tsuji | H01R 13/113 439/852 |
| 2014/0315417 | A1* | 10/2014 | Wada | H01R 13/113 439/357 |
| 2015/0087192 | A1* | 3/2015 | Tanigawa | H01R 13/187 439/852 |
| 2015/0111419 | A1* | 4/2015 | Komiyama | H01R 13/11 439/510 |
| 2015/0263456 | A1* | 9/2015 | Hashimoto | H01R 13/113 439/752.5 |
| 2016/0006143 | A1* | 1/2016 | Chikusa | H01R 4/48 439/816 |
| 2016/0013569 | A1* | 1/2016 | Chikusa | H01R 13/113 439/816 |
| 2016/0072203 | A1* | 3/2016 | Ii | H01R 4/48 439/816 |
| 2016/0079686 | A1* | 3/2016 | Shinmi | H01R 13/115 439/842 |

FOREIGN PATENT DOCUMENTS

| | | |
|---|---|---|
| JP | 2001-210418 | 8/2001 |
| JP | 2002-190336 | 7/2002 |
| JP | 2003-243076 | 8/2003 |
| JP | 2006-120370 | 5/2006 |
| JP | 2012-199069 | 10/2012 |

* cited by examiner

FEMALE TERMINAL FITTING

BACKGROUND

1. Field of the Invention

The present invention relates to a female terminal fitting.

2. Description of the Related Art

A female terminal fitting disclosed in Japanese Unexamined Patent Publication No. 2003-243076 includes a tubular main body portion (called an "electrical contact portion" in Japanese Unexamined Patent Publication No. 2003-243076) into which a male tab is inserted, and a resilient contact piece deflectably arranged in the main body portion and configured to resiliently come into contact with the male tab (called a "male terminal" in Japanese Unexamined Patent Publication No. 2003-243076). Further, excessive deflection preventing pieces formed by being cut and bent inwardly to prevent excessive deflection of the resilient contact piece are provided on opposite side walls of the main body portion.

In the above case, as the excessive deflection preventing pieces are formed, holes are open on the opposite side walls. Thus, there has been a possibility that external matters enter the main body portion through the holes. Particularly, since the holes are located near a contact portion where the resilient contact piece comes into contact with the male tab, there has been a possibility that an external matter having entered through the hole adheres to the contact portion and there has been a concern that electrical contact reliability is impaired. Further, since the holes are provided on the opposite side walls, there has been also a concern that the strength of the main body portion is reduced.

The present invention was completed based on the above situation and aims to provide a female terminal fitting capable of preventing excessive deflection of a resilient contact piece even without forming a hole on a side wall of a main body portion.

SUMMARY

The present invention is directed to a female terminal fitting with a tubular main body and a resilient contact piece deflectably arranged in the main body, a mating male tab coming into contact with the resilient contact piece to deflect and deform the resilient contact piece toward a base wall of the main body when the male tab is inserted into the main body. An excessive deflection regulating portion is arranged on the base wall of the main body at a position facing the resilient contact piece in a deflecting direction of the resilient contact piece and is configured to regulate excessive deflection of the resilient contact piece.

Since the excessive deflection regulating portion is provided on the base wall of the main body, excessive deflection of the resilient contact piece can be prevented even without forming a hole on a side wall of the main body portion.

Two of the excessive deflection regulating portions may be arranged at positions facing opposite widthwise end parts of the resilient contact piece. Thus, the resilient contact piece that is about to be deflected excessively is supported stably on the excessive deflection regulating portions.

The main body may have an auxiliary spring piece configured to assist a spring force of the resilient contact piece by contacting the resilient contact piece in the deflecting direction of the resilient contact piece. The auxiliary spring piece may be formed by cutting the base wall and bending a cut piece from a hole left on the base wall. The excessive deflection regulating portion also may be cut and bent from the hole. Thus, the excessive deflection regulating portion and the auxiliary spring piece may be provided commonly using one hole so that the configuration of the main body can be simplified. Further, the strength of the main body can be ensured since an unnecessarily large hole is not open on the main body.

The excessive deflection regulating portion may be be cut and bent from the hole of the base wall and may include a regulating surface at opposite sides of the hole and at positions facing the resilient contact piece. The regulating surface may be raised to be closer to the resilient contact piece than other parts of the base wall. The resilient contact piece comes into line or surface contact with the regulating surface of the excessive deflection regulating portion so that excessive deflection of the resilient contact piece can be regulated stably.

The female terminal fitting is resiliently lockable by a locking lance projecting at an inner wall of a cavity of a connector housing when being inserted into the cavity, and the main body is provided with a lance receiving space, into which the locking lance is insertable, in a bottom-raising height range of the excessive deflection regulating portion. Since an insertion amount of the locking lance is ensured utilizing the bottom-raised height of the excessive deflection regulating portion, space efficiency is excellent.

The base wall is provided with a locking projection lockable to the locking lance by striking an edge part of the hole outwardly. Since the locking projection is provided utilizing the hole, the configuration is simplified as compared with the case where the locking projection is provided separately and, consequently, the miniaturization of the terminal fitting can be coped with.

BRIEF DESCRIPTON OF THE DRAWINGS

DETAILED DESCRIPTION

One embodiment of the present invention is described with reference to FIGS. 1 to 6. A female terminal fitting 10 of the embodiment is formed by applying bending and the like to an electrically conductive metal plate and includes a tubular main body 20 into which a mating male tab 90 (see FIG. 6) is inserted. Note that although the female terminal fitting 10 includes a part to be connected to an end part of a wire (not shown) behind the main body portion 20, this part is neither shown nor described here.

Figure 1:
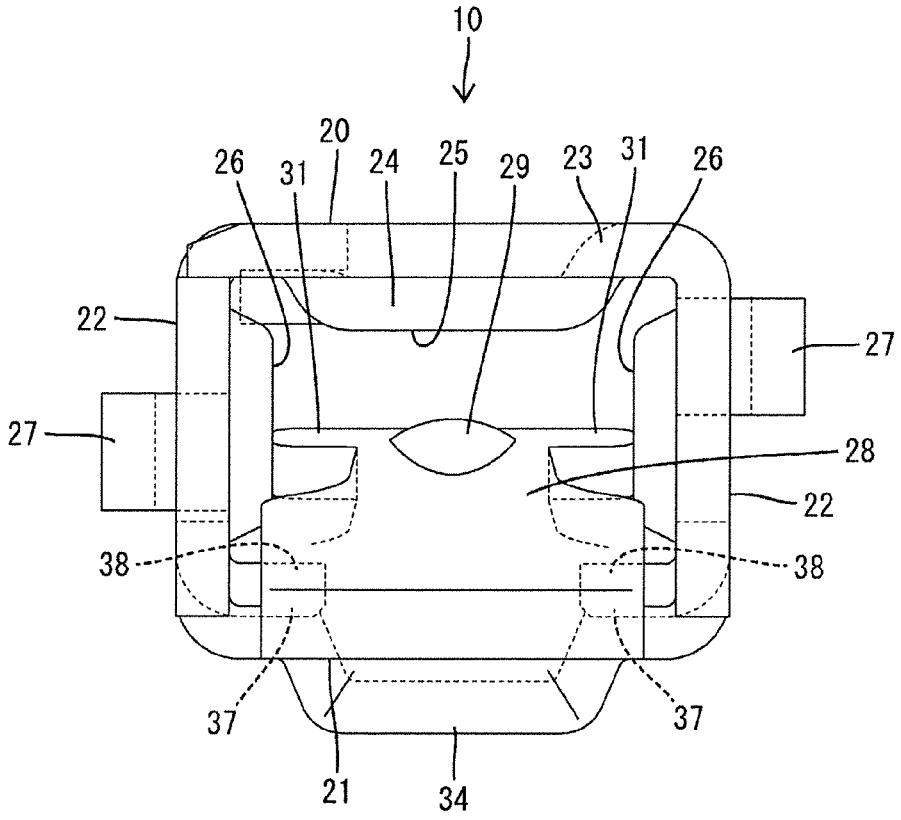
FIG. 1 is a front view of a female terminal fitting according to an embodiment of the present invention.
Figure 2:
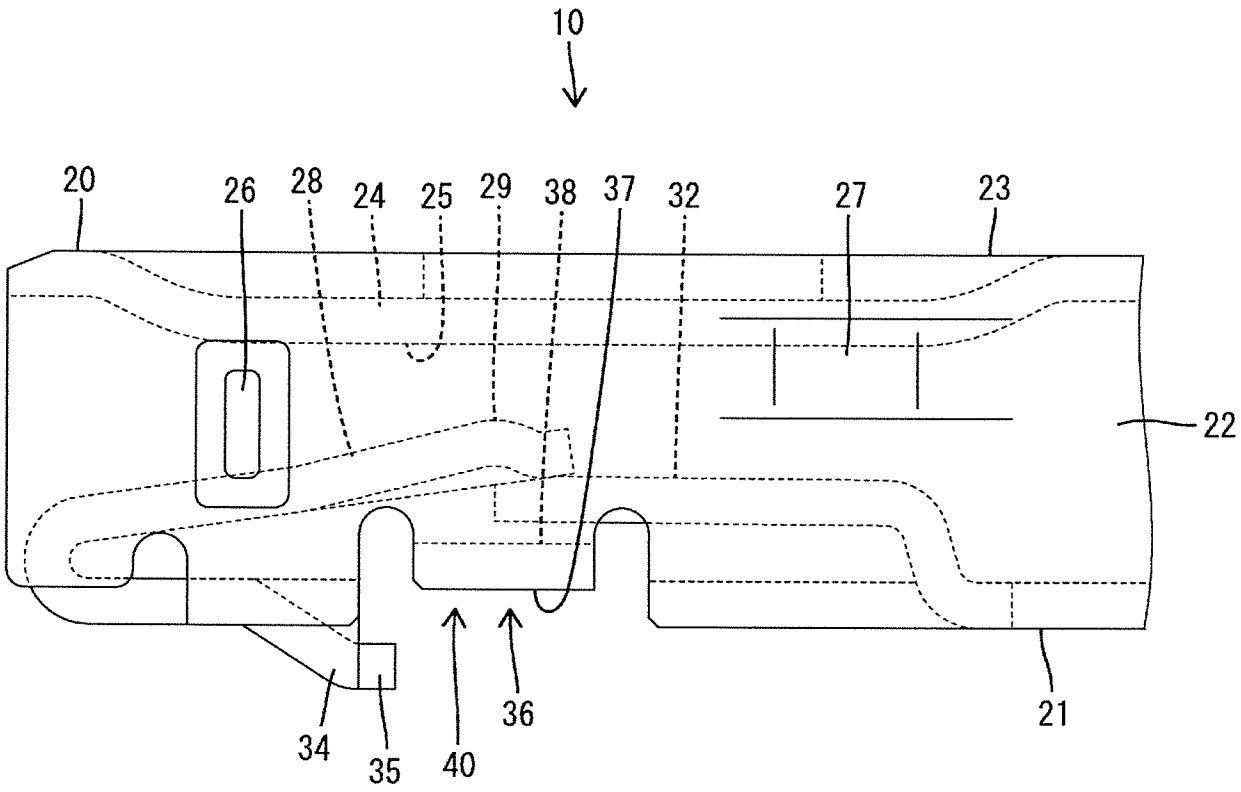
FIG. 2 is a side view of a main body portion.
Figure 3:
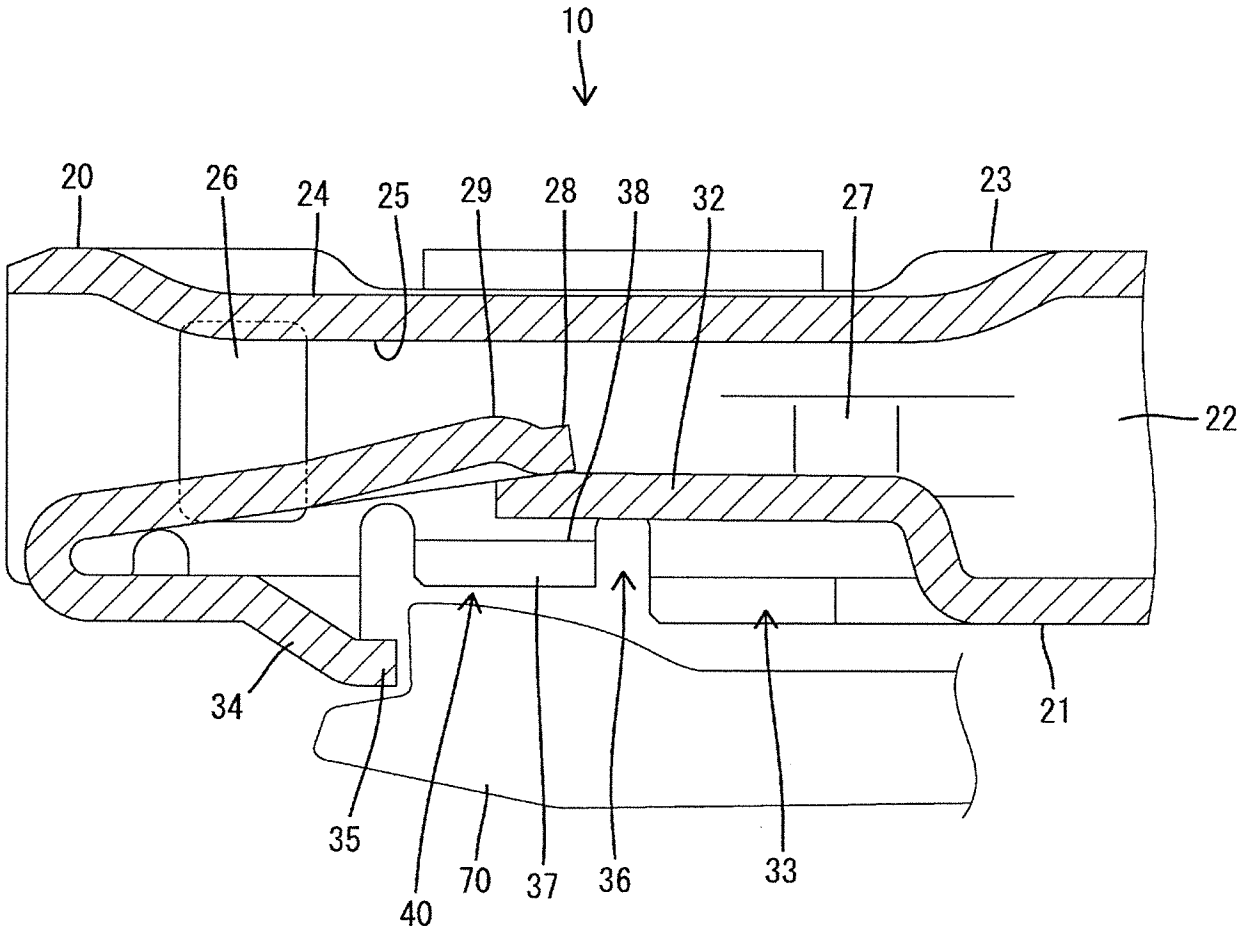
FIG. 3 is a side view in section of the main body portion.
Figure 5:
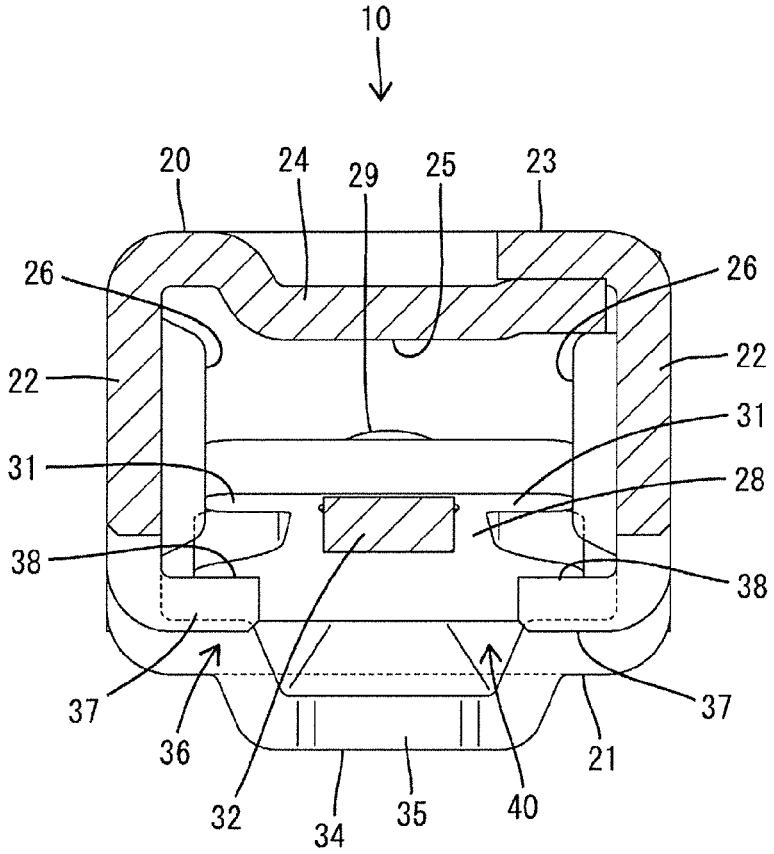
FIG. 5 is a rear view in section of the main body portion.

The main body 20 is in the form of a rectangular tube and, as shown in FIGS. 1 and 5, includes a base wall 21 extending substantially along a width direction, a pair of side walls 22 standing up from opposite widthwise ends of the base wall 21 and a facing wall 23 extending from an upper end part of one side wall 22 to an upper end part of the other side wall 22. A receiving portion 24 bent inwardly of the main body 20 is provided on the facing wall 23. As shown in FIG. 3, the receiving portion 24 has a receiving surface 25 extending along a front-back direction and contacts the upper surface of the male tab 90 to sandwich the male tab 90 between the receiving portion 24 and a later-described resilient contact piece 28.

Figure 4:
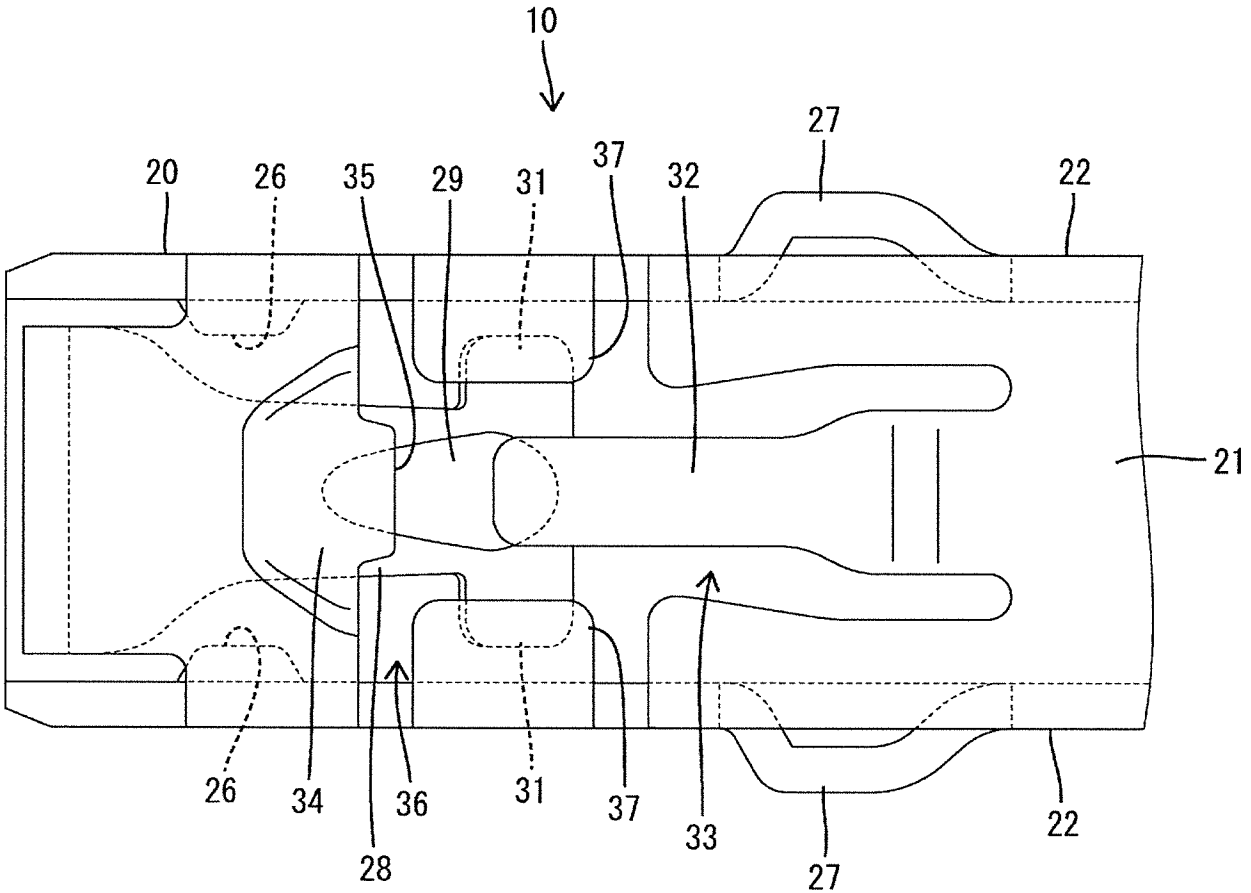
FIG. 4 is a bottom view of the main body portion.

As shown in FIGS. 1 and 4, front end parts of the opposite side walls 22 are struck to project inwardly, thereby providing a pair of backlash preventing portions 26. The backlash preventing portions 26 are arranged at opposite widthwise sides of an insertion path for the male tab 90 in the main body portion 20 and function to regulate the rattling of the male tab 90 in the width direction in the main body 20 by reducing clearances to opposite widthwise end surfaces of the male tab 90.

Further, as shown in FIG. 4, rear end parts of the opposite side walls 22 are cut and bent outwardly, thereby providing a pair of stabilizers 27. As shown in FIG. 1, the stabilizers 27 are arranged at height positions of the opposite side walls 22 different from each other. Here, when the female terminal fitting 10 is inserted into a cavity (not shown) of a connector housing (not shown), the stabilizers 27 are fit and inserted into guiding grooves communicating with the cavity to guide an inserting operation of the female terminal fitting 10. Further, when the female terminal fitting 10 is in an incorrect posture different from a proper insertion posture, the stabilizers 27 interfere with the rear surface of the connector housing without being inserted into the guiding grooves so that the female terminal fitting 10 is prevented from being inserted in the incorrect posture into the cavity.

As shown in FIG. 3, the deflectable resilient contact piece 28 is arranged in the main body 20. The resilient contact piece 28 is formed by folding a part extending forward from the front end of the base wall 21 in a development state backwardly and extends obliquely up to the back from the front end of the base wall 21. The resilient contact piece 28 is vertically deflectable and deformable with the front end of the base wall 21 as a support. As shown in FIGS. 1 and 4, a rear end part of the resilient contact piece 28 is struck to project up, thereby providing an embossed contact portion 29. Further, on the rear end part of the resilient contact piece 28, two protruding portions 31 protrude toward opposite lateral sides at opposite sides of the contact portion 29.

When the male tab 90 is inserted into the main body 20, the resilient contact piece 28 is pressed by the male tab 90 to be deflected and deformed down (toward the base wall 21). In that state, the contact portion 29 resiliently contacts the male tab 90 so that the female terminal fitting 10 is connected electrically conductively to the male tab 90 between the contact portion 29 and the receiving portion 24. Note that, as shown in FIG. 4, the resilient contact piece 28 is constricted to be narrower in an intermediate part in the front-back direction than the front and rear end parts.

Further, as shown in FIG. 3, a deflectable auxiliary spring piece 32 is arranged in the main body 20 separately from the resilient contact piece 28. The auxiliary spring piece 32 is formed by cutting and bending a part of the base wall 21 while leaving a hole 33 on the base wall 21 and extends forward from the rear end edge of the hole 33 as shown in FIG. 4. As shown in FIG. 3, a front end part of the auxiliary spring piece 32 is arranged to be able to contact the rear end part of the resilient contact piece 28 from below and functions to assist a spring force of the resilient contact piece 28 by supporting the resilient contact piece 28 from below. As shown in FIG. 4, the auxiliary spring piece 32 is narrower than the resilient contact piece 28 as a whole and the front end part of the auxiliary spring piece 32 can contact a widthwise central part of the rear end part of the resilient contact piece 28.

Further, as shown in FIG. 3, a claw-like locking projection 34 is struck to project downwardly, i.e. outwardly of the main body 20, from the front end edge of the hole 33 and at a position of the base wall 21 before the auxiliary spring piece 32. An auxiliary projection 35 projects back from the rear edge of the lower end of the locking projection 34. A locking lance 70 is lockable to the rear end edge of the auxiliary projection 35, i.e. the front end edge of the hole 33.

As shown in FIGS. 4 and 5, a bottom-raising hole 36 is provided in a range from the base wall 21 to lower end parts of the opposite side walls 22 in a front end part of the hole 33 and the base wall 21 is provided with a pair of excessive deflection regulating portions 37 cut and bent inwardly from the bottom-raising hole 36. The excessive deflection regulating portions 37 are arranged while being raised to a one-level higher position to be closer to the resilient contact piece 28 with respect to reference surfaces of the base wall 21 (wall surfaces of parts of the base wall 21 at opposite front and rear ends of the hole 33) and have regulating surfaces 38 arranged substantially horizontally to face the protruding portions 31 of the resilient contact piece 28 at positions facing the both protruding portions 31 of the resilient contact piece 28 from below (deflecting direction of the resilient contact piece 28) as shown in FIG. 5. Further, the excessive deflection regulating portions 37 are arranged at opposite sides of the front end part of the auxiliary spring piece 32 in the width direction and below the front end part of the auxiliary spring piece 32 in a natural state in a height direction. Further, as shown in FIG. 4, the excessive deflection regulating portions 37 are rectangular in a bottom view and have a length in the front-back direction exceeding that of the protruding portions 31 of the resilient contact piece 28. Note that a lance receiving space 40 capable of receiving the locking lance 70 to be described later is open below the excessive deflection regulating portions 37 in the main body 20 as shown in FIG. 3.

Next, functions and effects of the female terminal fitting 10 of the embodiment are described.

When the female terminal fitting 10 is inserted into the cavity of the connector housing and reaches a proper insertion position, a tip part of the locking lance 70 projecting at an inner wall of the cavity is resiliently fitted into the lance receiving space 40 of the main body 20 and is arranged to be lockable to the auxiliary projection 35 of the locking projection 34, thereby retaining the female terminal fitting 10 in the cavity. In this case, by locating the excessive deflection regulating portions 37 higher than the reference surfaces of the base wall 21, a recess amount of the lance receiving space 40 in the height direction is increased and the tip part of the locking lance 70 can be inserted deeply into the lance receiving space 40.

Subsequently, when the connector housing is connected to a mating connector housing (not shown), the male tab 90 mounted in the mating connector housing is inserted into the main body 20, the resilient contact piece 28 comes into contact with the male tab 90 to be deflected and deformed down, and the auxiliary spring piece 32 also is pressed by the resilient contact piece 28 to be deflected and deformed down. When the male tab 90 is inserted to a proper depth, the male tab 90 is sandwiched resiliently between the contact portion 29 of the resilient contact piece 28 and the receiving surface 25 of the receiving portion 24 to achieve proper electrically conductive connection of the female terminal fitting 10 to the male tab 90.

Figure 6:
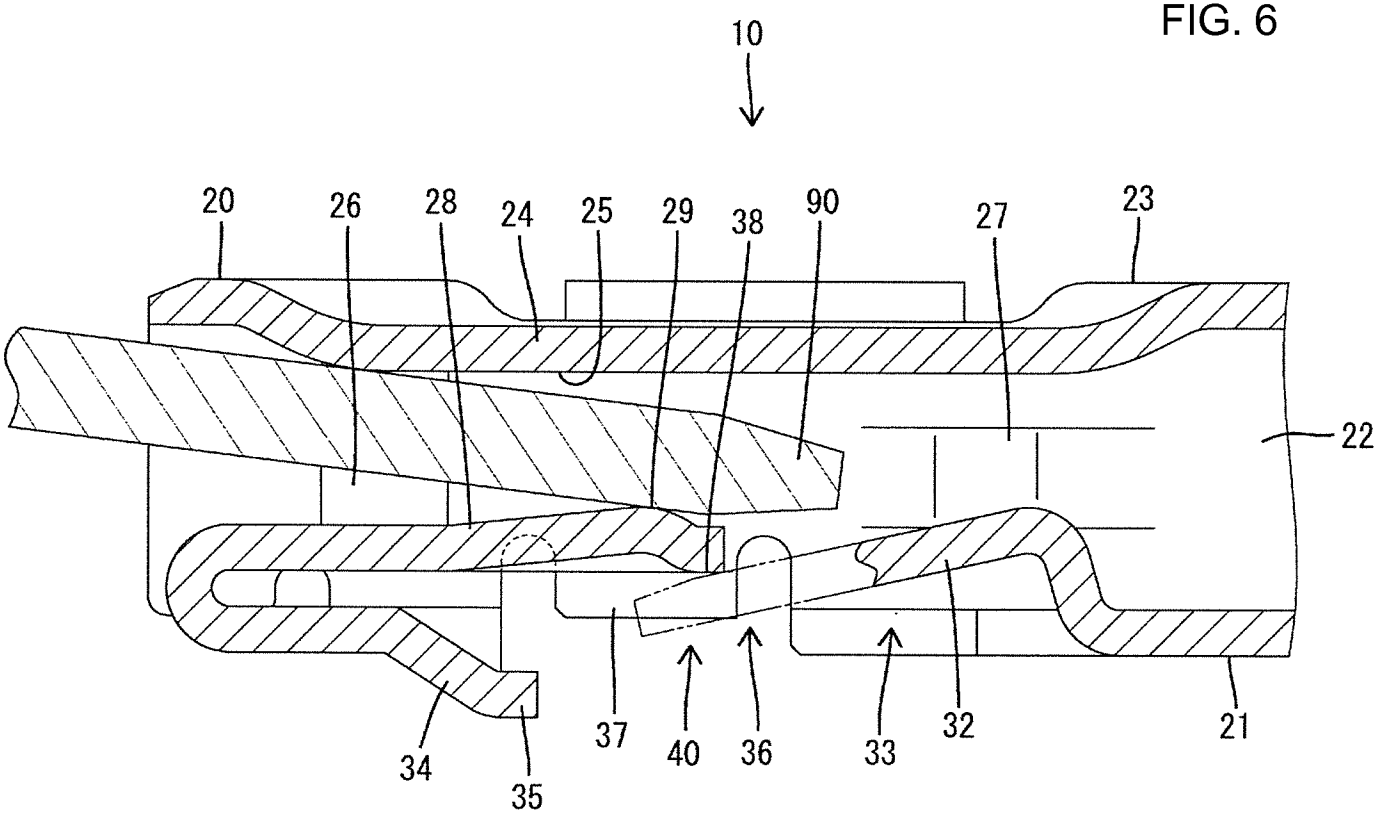
FIG. 6 is a section showing a state where a resilient contact piece is in contact with an excessive deflection regulating portion to regulate excessive deflection of the resilient contact piece.

On the other hand, if an excessive external force acts on the resilient contact piece, such as due to an incorrect insertion posture of the male tab 90 as shown in FIG. 6, there is a possibility that the resilient contact piece 28 is deflected excessively and deformed down together with the auxiliary spring piece 32. However, according to the embodiment, the protruding portions 31 of the resilient contact piece 28 come into line or surface contact with the regulating surfaces 38 of the excessive deflection regulating portions 37 to regulate any further deflection of the resilient contact piece 28 before the resilient contact piece 28 is deflected and deformed excessively, wherefore excessive deflection of the resilient contact piece 28 is prevented. Note that, in a state where the protruding portions 31 of the resilient contact piece 28 are in contact with the both excessive deflection regulating portions 37, the front end part of the auxiliary spring piece is arranged to overlap the both excessive deflection regulating portions 37 in the height direction.

As described above, the excessive deflection regulating portions 37 are provided on the base wall 21 of the main body 20 to prevent excessive deflection of the resilient contact piece 28 even without forming holes on the side walls 22 of the main body 20. In this case, the excessive deflection regulating portions 37 are provided at the positions facing the protruding portions 31 on the opposite widthwise end parts of the resilient contact piece 28. Thus, the resilient contact piece 28 is supported stably on the excessive deflection regulating portions 37. Further, by arranging the auxiliary spring piece 32 between the excessive deflection regulating portions 37, the excessive deflection regulating portions 37 and the auxiliary spring piece 32 are arranged space-efficiently within the width of the base wall 21.

Further, the excessive deflection regulating portions 37 and the auxiliary spring piece 32 both are cut and bent from the hole 33 of the base wall 21 and commonly use one hole 33, thereby simplifying the configuration of the main body 20. Further, since an unnecessarily large hole is not open on the main body 20, specified strength can be ensured for the main body portion 20.

The invention is not limited to the above described and illustrated embodiment. For example, the following modes are also included in the scope of the invention.

The excessive deflection regulating portions may come into contact with the auxiliary spring piece to regulate excessive deflection of the resilient contact piece.

One, three or more excessive deflection regulating portions may be provided on the base wall.

Depending on cases, the auxiliary spring piece may be omitted. In this case, the excessive deflection regulating portion may be arranged at a position facing a widthwise central part of the resilient contact piece.

The excessive deflection regulating portion may be formed to stand up on the base wall and the standing end thereof may be arranged at a position facing the resilient contact piece.

The excessive deflection regulating portion may be arranged at a position facing a part of the resilient contact piece before the rear end part.

List of Reference Signs

10 . . . female terminal fitting
20 . . . main body portion
21 . . . base wall
22 . . . side wall
28 . . . resilient contact piece
31 . . . protruding portion
32 . . . auxiliary spring piece
33 . . . hole
37 . . . excessive deflection regulating portion
90 . . . male tab

The invention claimed is:

1. A female terminal fitting with a tubular main body and a resilient contact piece deflectably arranged in the main body, a mating male tab coming into contact with the resilient contact piece to deflect and deform the resilient contact piece toward a base wall of the main body portion when the male tab is inserted into the main body, wherein:

an excessive deflection regulating portion arranged at a position facing the resilient contact piece in a deflecting direction of the resilient contact piece and configured to regulate excessive deflection of the resilient contact piece is provided on the base wall of the main body portion;

the main body includes a pair of side walls standing up from opposite widthwise ends of the base wall;

the base wall is provided with a hole left by cutting the base wall to form an auxiliary spring piece and bending the auxiliary spring piece into the main body, the auxiliary spring piece being configured to assist a spring force of the resilient contact piece by coming into contact with the resilient contact piece in the deflecting direction of the resilient contact piece and a bottom-raising hole is provided in a range from the base wall to lower end parts of the side walls in the hole;

two excessive deflection regulating portions are cut and bent from the side walls and the base wall at the bottom-raising hole and located on the sides of the pair of side walls and include regulating surfaces bottom-raised to a one-level higher position to be closer to the resilient contact piece and arranged substantially horizontally at positions facing opposite widthwise end parts of the resilient contact piece in a deflecting direction of the resilient contact piece and configured to regulate excessive deflection of the resilient contact piece;

the female terminal fitting is resiliently lockable by a locking lance projecting at an inner wall of a cavity of a connector housing when being inserted into the cavity; and a lance receiving space into which the locking lance is insertable is provided below the excessive deflection regulating portions.

2. The female terminal fitting of claim 1, wherein the base wall is provided with a locking projection lockable to the locking lance by striking an edge part of the hole outwardly.

3. A female terminal fitting with a tubular main body and a resilient contact piece deflectably arranged in the main body, a mating male tab coming into contact with the resilient contact piece to deflect and deform the resilient contact piece toward a base wall of the main body portion when the male tab is inserted into the main body, wherein:

an excessive deflection regulating portion arranged at a position facing the resilient contact piece in a deflecting direction of the resilient contact piece and configured to regulate excessive deflection of the resilient contact piece is provided on the base wall of the main body portion;

the main body includes a pair of side walls standing up from opposite widthwise ends of the base wall;

the base wall is provided with a hole left by cutting the base wall and bending a cut piece and a bottom-raising hole is provided in a range from the base wall to lower end parts of the side walls in the hole;

two excessive deflection regulating portions are cut and bent from the side walls and the base wall at the bottom-raising hole and located on the sides of the pair of side walls and include regulating surfaces bottom-raised to a one-level higher position to be closer to the resilient contact piece and arranged substantially horizontally at positions facing opposite widthwise end parts of the resilient contact piece in a deflecting direction of the resilient contact piece and configured to regulate excessive deflection of the resilient contact piece;

the female terminal fitting is resiliently lockable by a locking lance projecting at an inner wall of a cavity of a connector housing when being inserted into the cavity; and a lance receiving space into which the locking lance is insertable is provided below the excessive deflection regulating portions, and wherein the base wall is provided with a locking projection lockable to the locking lance by striking an edge part of the hole outwardly.

4. A female terminal fitting comprising:

a tubular main body having opposite front and rear ends, a base wall, a facing wall opposed to the base wall and opposite first and second side walls bent from the base wall and extending toward the facing wall;

a resilient contact piece extending from the base wall at the front end of the main body and bent into the main body so that a mating male tab inserted into the front end of the main body contacts the resilient contact piece and deflects the resilient contact piece toward the base wall;

an auxiliary spring piece cut from the base wall and bent into the main body, the auxiliary spring piece being configured to contact with the resilient contact piece in a deflecting direction of the resilient contact piece to assist a spring force of the resilient contact piece;

excessive deflection regulating portions cut from the base wall and from portions of the side walls adjacent the base wall and bent into the main body so that upper surfaces of the excessive deflection regulating portions are at positions higher than the base wall and facing opposite widthwise sides of a lower surface of the resilient contact piece in the deflecting direction of the resilient contact piece to regulate excessive deflection of the resilient contact piece; and a lance receiving space is provided below the excessive deflection regulating portions for receiving a locking lance projecting at an inner wall of a cavity of a connector housing when the female terminal fitting is inserted into the cavity.

5. The female terminal fitting of claim 4, wherein the excessive deflection regulating portions are spaced laterally outward of the auxiliary spring piece and at positions farther from the resilient contact piece than the auxiliary spring piece in on deflected conditions of the resilient contact piece and the auxiliary spring piece.

6. The female terminal fitting of claim 5, wherein the resilient contact piece has lateral protrusions and the excessive deflection regulating portions being opposed to the lateral protrusions of the resilient contact piece in the deflecting direction of the resilient contact piece.

* * * * *